US011741868B2

(12) United States Patent
Nam et al.

(10) Patent No.: US 11,741,868 B2
(45) Date of Patent: Aug. 29, 2023

(54) REFERENCE VOLTAGE GENERATOR, DISPLAY DEVICE INCLUDING THE SAME, AND METHOD OF DRIVING DISPLAY DEVICE

(71) Applicant: Samsung Display Co., Ltd., Yongin-Si (KR)

(72) Inventors: Hyungrae Nam, Hwaseong-si (KR); Jin-Taek Hong, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/963,801

(22) Filed: Oct. 11, 2022

(65) Prior Publication Data

US 2023/0230514 A1 Jul. 20, 2023

(51) Int. Cl.

| | |
|---|---|
| ***G09G 3/36*** | (2006.01) |
| ***G09G 3/00*** | (2006.01) |
| ***G09G 3/32*** | (2016.01) |

(52) U.S. Cl.

CPC ..... *G09G 3/006* (2013.01); *G09G 3/32* (2013.01); *G09G 2310/0291* (2013.01); *G09G 2310/08* (2013.01); *G09G 2320/0276* (2013.01); *G09G 2330/028* (2013.01)

(58) Field of Classification Search

CPC .. G09G 3/006; G09G 3/32; G09G 2310/0291; G09G 2310/08; G09G 2320/0276; G09G 2330/028; G09G 3/3614; H05B 45/20; H03K 5/24

USPC ..... 315/307

See application file for complete search history.

(56) References Cited

U.S. PATENT DOCUMENTS

| | | | | |
|---|---|---|---|---|
| 2016/0183342 | A1* | 6/2016 | Jang | H05B 45/20 315/307 |
| 2018/0012553 | A1* | 1/2018 | Kim | G09G 3/3614 |
| 2018/0308448 | A1* | 10/2018 | Lee | H03K 5/24 |

FOREIGN PATENT DOCUMENTS

| | | | |
|---|---|---|---|
| KR | 10-0369342 | B1 | 3/2003 |
| KR | 10-2011-0090006 | A | 8/2011 |
| KR | 10-2017-0032509 | A | 3/2017 |
| KR | 10-2017-0097109 | A | 8/2017 |
| KR | 10-2020-0039931 | A | 4/2020 |

* cited by examiner

*Primary Examiner* — Abdul-Samad A Adediran

(74) *Attorney, Agent, or Firm* — Innovation Counsel LLP

(57) ABSTRACT

Provided is a display device which comprises a display panel including a plurality of pixels displaying an image based on a driving voltage, a reference voltage generator converting a sensing driving voltage generated by measuring the driving voltage into a sensing driving current, converting a preset reference driving voltage into a reference driving current, comparing the sensing driving current and the reference driving current, and generating a first reference voltage and a second reference voltage based on a difference between the sensing driving current and the reference driving current, a gamma voltage generator generating a plurality of gamma voltages by dividing the first reference voltage and the second reference voltage, and a data driver converting image data into a data voltage based on the gamma voltages and providing the data voltage to each of the pixels.

20 Claims, 7 Drawing Sheets

REFERENCE VOLTAGE GENERATOR, DISPLAY DEVICE INCLUDING THE SAME, AND METHOD OF DRIVING DISPLAY DEVICE

CROSS-REFERENCE TO RELATED APPLICATION(S)

This application claims priority under 35 USC § 119 to Korean Patent Application No. 10-2022-0007657 filed on Jan. 19, 2022 in the Korean Intellectual Property Office (KIPO), the entire disclosure of which is incorporated by reference herein.

BACKGROUND

1. Field

The present disclosure generally relates to a display device. More particularly, the present disclosure relates to a display device including a reference voltage generator and a method of driving the same.

2. Description of the Related Art

With the development of multimedia, the importance of a display device is gradually increasing. Accordingly, various display devices such as a liquid crystal display (LCD) device, an organic light emitting display (OLED) device, and etc. have been developed.

The display device may include a display panel and a driver. The display panel may include a plurality of pixels. The driver may include a scan driver that provides scan signals to the pixels and a data driver that provides data voltages to the pixels. The data driver may convert digital image data into analog data voltages based on gamma voltages (or grayscale voltages).

A driving voltage for driving the pixels may be provided to the display panel. When the driving voltage changes, a driving current may change so that an undesired pattern (e.g., a crosstalk pattern) may be visually recognized on a display screen. The driving voltage may change depending on resistances of wirings in the display panel, a capacitance between the wirings, or the like.

SUMMARY

Embodiments provide a reference voltage generator for rapidly compensating a change in the driving voltage and generating a reference voltage that does not include noise.

Embodiments provide a display device including the reference voltage generator.

Embodiments provide a method of driving the display device.

A display device according to embodiments may include a display panel including a plurality of pixels displaying an image based on a driving voltage, a reference voltage generator converting a sensing driving voltage generated by measuring the driving voltage into a sensing driving current, converting a preset reference driving voltage into a reference driving current, comparing the sensing driving current and the reference driving current, and generating a first reference voltage and a second reference voltage based on a difference between the sensing driving current and the reference driving current, a gamma voltage generator generating a plurality of gamma voltages by dividing the first reference voltage and the second reference voltage, and a data driver converting image data into a data voltage based on the gamma voltages and providing the data voltage to each of the pixels.

In an embodiment, the reference voltage generator may include a first voltage-to-current converter converting the sensing driving voltage into the sensing driving current, a second voltage-to-current converter converting the reference driving voltage into the reference driving current, a current comparator comparing the sensing driving current and the reference driving current, and a current-to-voltage converter generating the first reference voltage and the second reference voltage based on the difference between the sensing driving current and the reference driving current.

In an embodiment, the current-to-voltage converter may include a first current-to-voltage converter generating the first reference voltage based on a first initial reference voltage and the difference between the sensing driving current and the reference driving current, and a second current-to-voltage converter generating the second reference voltage based on a second initial reference voltage and the difference between the sensing driving current and the reference driving current.

In an embodiment, the first current-to-voltage converter may include a first amplifier outputting the first reference voltage based on the first initial reference voltage and the difference between the sensing driving current and the reference driving current, and the second current-to-voltage converter may include a second amplifier outputting the second reference voltage based on the second initial reference voltage and the difference between the sensing driving current and the reference driving current.

In an embodiment, the first voltage-to-current converter may include a first amplifier having a first input terminal to which the sensing driving voltage is applied, a first resistor connected to a second input terminal of the first amplifier, and through which the sensing driving current flows, and a first transistor series-connected to the first resistor, and having a gate electrode connected to an output terminal of the first amplifier. The second voltage-to-current converter may include a second amplifier having a first input terminal to which the reference driving voltage is applied, a second resistor connected to a second input terminal of the second amplifier, and through which the reference driving current flows, and a second transistor series-connected to the second resistor, and having a gate electrode connected to an output terminal of the second amplifier.

In an embodiment, the current comparator may include a first transistor through which the sensing driving current flows, and a second transistor series-connected to the first transistor, and through which the reference driving current flows.

In an embodiment, the first transistor may be an N-type metal oxide semiconductor ("NMOS") transistor, and the second transistor may be a P-type metal oxide semiconductor ("PMOS") transistor.

In an embodiment, the reference voltage generator may further include a current minor block transmitting the sensing driving current generated from the first voltage-to-current converter and the reference driving current generated from the second voltage-to-current converter to the current comparator.

In an embodiment, the reference voltage generator may further include a first current clamp limiting a range of the sensing driving current, and a second current clamp limiting a range of the reference driving current.

In an embodiment, the display device may further include a timing controller controlling a driving of the data driver, and providing the reference driving current to the reference voltage generator.

In an embodiment, the reference driving voltage may be a target driving voltage in driving the pixels normally.

In an embodiment, the display device may further include a power supply providing the driving voltage to the pixels, and providing a first initial reference voltage for generating the first reference voltage and a second initial reference voltage in order to generate the second reference voltage to the reference voltage generator.

A reference voltage generator according to embodiments may include a first voltage-to-current converter converting a sensing driving voltage generated by measuring a driving voltage provided to pixels into a sensing driving current, a second voltage-to-current converter converting a preset reference driving voltage into a reference driving current, a current comparator comparing the sensing driving current and the reference driving current, and a current-to-voltage converter generating a first reference voltage and a second reference voltage based on a difference between the sensing driving current and the reference driving current.

In an embodiment, the current-to-voltage converter may include a first current-to-voltage converter generating the first reference voltage based on a first initial reference voltage and the difference between the sensing driving current and the reference driving current, and a second current-to-voltage converter generating the second reference voltage based on a second initial reference voltage and the difference between the sensing driving current and the reference driving current.

In an embodiment, the first current-to-voltage converter may include a first amplifier outputting the first reference voltage based on the first initial reference voltage and the difference between the sensing driving current and the reference driving current, and the second current-to-voltage converter may include a second amplifier outputting the second reference voltage based on the second initial reference voltage and the difference between the sensing driving current and the reference driving current.

In an embodiment, the current comparator may include a first transistor through which the sensing driving current flows, and a second transistor series-connected to the first transistor, and through which the reference driving current flows.

In an embodiment, the first transistor may be an NMOS transistor, and the second transistor may be a PMOS transistor.

In an embodiment, the reference voltage generator may further include a current minor block transmitting the sensing driving current generated from the first voltage-to-current converter and the reference driving current generated from the second voltage-to-current converter to the current comparator.

A method of driving a display device according to embodiments may include steps of generating a sensing driving voltage by measuring a driving voltage provided to a plurality of pixels, converting the sensing driving voltage into a sensing driving current, converting a preset reference driving voltage into a reference driving current, comparing the sensing driving current and the reference driving current, generating a first reference voltage and a second reference voltage based on a difference between the sensing driving current and the reference driving current, and generating a plurality of gamma voltages by dividing the first reference voltage and the second reference voltage.

In an embodiment, generating the first reference voltage and the second reference voltage may be accomplished by generating the first reference voltage based on a first initial reference voltage and the difference between the sensing driving current and the reference driving current, and generating the second reference voltage based on a second initial reference voltage and the difference between the sensing driving current and the reference driving current.

In the reference voltage generator, the display device, and the method of driving the display device according to the embodiments, the sensing driving voltage and the reference driving voltage may be respectively converted into the sensing driving current and the reference driving current, the sensing driving current and the reference driving current may be compared, and the reference voltage may be generated based on the difference between the sensing driving current and the reference driving current, so that the change in the driving voltage may be rapidly compensated, and the reference voltage may not include the noise.

BRIEF DESCRIPTION OF THE DRAWINGS

Illustrative, non-limiting embodiments will be more clearly understood from the following detailed description taken in conjunction with the accompanying drawings.

DETAILED DESCRIPTION OF THE EMBODIMENTS

Hereinafter, display devices, reference voltage generators, and methods of driving display devices in accordance with embodiments will be explained in detail with reference to the accompanying drawings.

Figure 1:
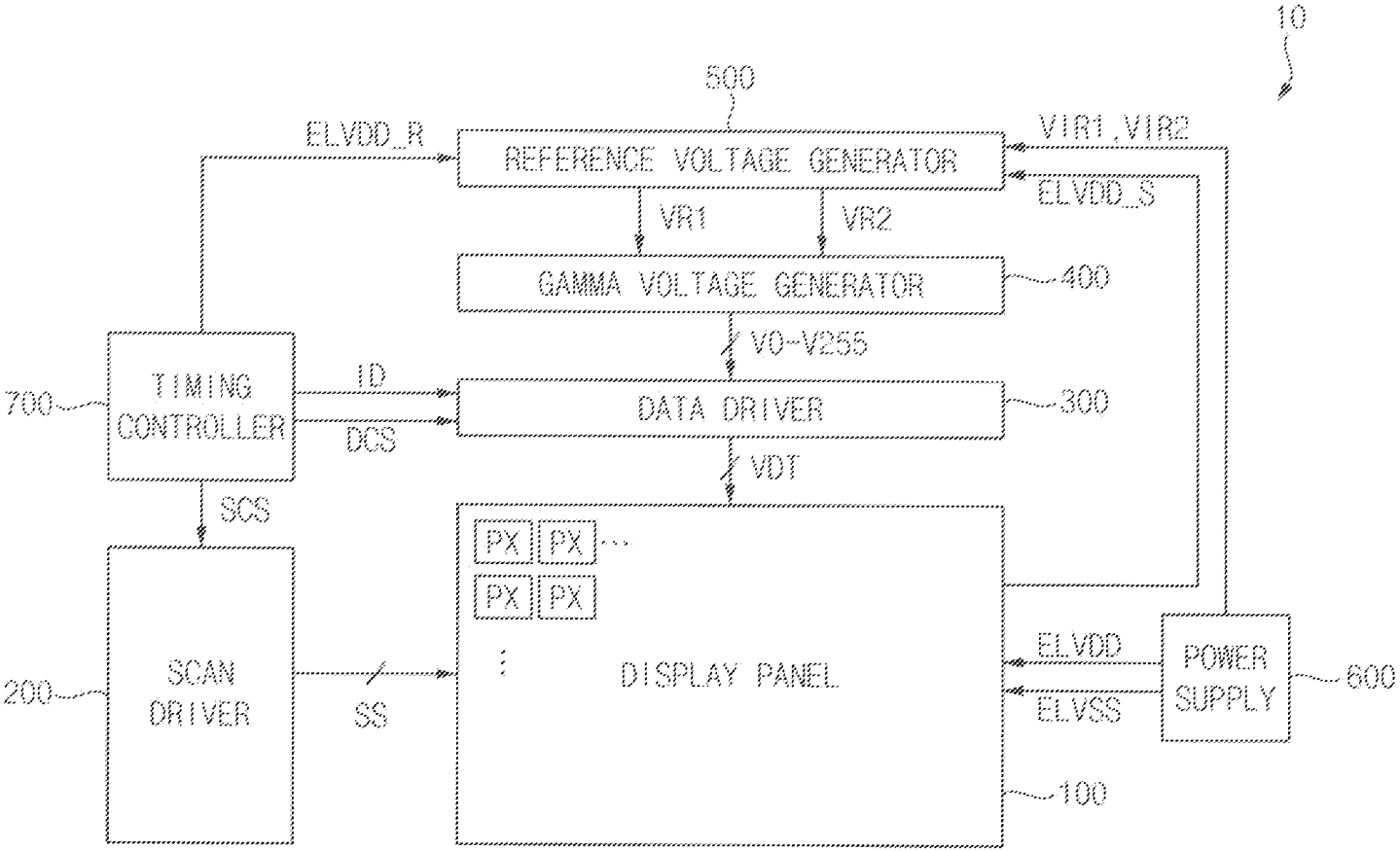
FIG. 1 is a block diagram illustrating a display device according to an embodiment.

FIG. 1 is a block diagram illustrating a display device 10 according to an embodiment.

Referring to FIG. 1, the display device 10 may include a display panel 100, a scan driver 200, a data driver 300, a gamma voltage generator 400, a reference voltage generator 500, a power supply 600, and a timing controller 700.

The display panel 100 may display an image. The display panel 100 may include various display elements such as an organic light emitting diode (OLED) or the like. Hereinafter, the display device 10 including the organic light emitting diode as a display element will be described for convenience. However, the present disclosure is not limited thereto, and the display device 10 may include various display elements such as a liquid crystal display (LCD) element, an electrophoretic display (EPD) element, and an inorganic light emitting diode, or the like.

The display panel 100 may include a plurality of pixels PX. Each of the pixels PX may be electrically connected to a data line DL in FIG. 2A and a scan line SL in FIG. 2A. Further, each of the pixels PX may be electrically connected to a driving voltage line ELVDDL in FIG. 2A and a common voltage line ELVSSL in FIG. 2A, and may receive a driving voltage ELVDD and a common voltage ELVSS from the driving voltage line ELVDDL and the common voltage line ELVSSL, respectively.

Each of the pixels PX may emit light with a luminance corresponding to a data voltage VDT provided through the data line DL in response to a scan signal SS provided through the scan line SL. Configuration and operation of the pixel PX will be described below with reference to FIGS. 2A and 2B.

The scan driver 200 (or a gate driver) may generate the scan signal SS (or a gate signal) based on a scan control signal SCS, and may transmit the scan signal SS to the scan line SL. The scan control signal SCS may include a start signal, a clock signal, or the like. For example, the scan driver 200 may sequentially generate and output the scan signal SS corresponding to the start signal using the clock signal. The scan driver 200 may be implemented as a shift register, but is not limited thereto. In an embodiment, the scan driver 200 may be formed on the display panel 100. In another embodiment, the scan driver 200 may be implemented as an integrated circuit and mounted on a flexible circuit board to be connected to the display panel 100.

The data driver 300 may generate the data voltage VDT based on image data ID, a data control signal DCS, and gamma voltages V0 to V255, and may provide the data voltage VDT to the data line DL. The data driver 300 may convert the image data ID into the data voltage VDT based on the gamma voltages V0 to V255. The data control signal DCS may include a load signal, a start signal, a clock signal, or the like. In an embodiment, the data driver 300 may be implemented as an integrated circuit (IC) (e.g., a driving IC), and mounted on a flexible circuit board to be connected to the display panel 100.

The gamma voltage generator 400 (or a grayscale voltage generator) may receive a first reference voltage VR1 and a second reference voltage VR2. The gamma voltage generator 400 may divide the first reference voltage VR1 and the second reference voltage VR2 to generate the plurality of gamma voltages V0 to V255 for a plurality of grayscales, and may provide the gamma voltages V0 to V255 to the data driver 300.

The gamma voltages V0 to V255 (or grayscale voltages) may be intermediate voltages between the first reference voltage VR1 and the second reference voltage VR2. The gamma voltages V0 to V255 may vary in response to the first reference voltage VR1 and the second reference voltage VR2. For example, when the first reference voltage VR1 and the second reference voltage VR2 increase at a constant rate, the gamma voltages V0 to V255 may also increase at a rate substantially equal to or similar to the rate at which the first reference voltage VR1 and the second reference voltage VR2 increase.

Hereinafter, for convenience of description, it will be described that a total of 256 grayscales from 0 grayscale (a minimum grayscale) to 255 grayscale (a maximum grayscale) exist, however, more grayscales may exist when expressing the grayscale values in excess of 8 bits. In this case, the minimum grayscale may be the darkest grayscale, and the maximum grayscale may be the brightest grayscale.

The reference voltage generator 500 may receive a reference driving voltage ELVDD_R, a sensing driving voltage ELVDD_S, a first initial reference voltage VIR1, and a second initial reference voltage VIR2, and may generate or control the first reference voltage VR1 and the second reference voltage VR2 based on the reference driving voltage ELVDD_R, the sensing driving voltage ELVDD_S, the first initial reference voltage VIR1, and the second initial reference voltage VIR2. The reference voltage generator 500 may provide the first reference voltage VR1 and the second reference voltage VR2 to the gamma voltage generator 400.

In an embodiment, a voltage level of the first reference voltage VR1 and a voltage level of the second reference voltage VR2 may be lower than a voltage level of the driving voltage ELVDD. In another embodiment, the voltage level of the first reference voltage VR1 may be higher than the voltage level of the driving voltage ELVDD, and the voltage level of the second reference voltage VR2 may be lower than the voltage level of the driving voltage ELVDD.

The reference driving voltage ELVDD_R may be a target driving voltage for normally driving the pixels PX of the display panel 100. The sensing driving voltage ELVDD_S may be a voltage generated by measuring the driving voltage ELVDD substantially provided to the pixels PX.

The power supply 600 may provide the driving voltage ELVDD and the common voltage ELVSS to the display panel 100. The voltage level of the driving voltage ELVDD may be higher than a voltage level of the common voltage ELVSS. The driving voltage ELVDD may be provided to a first side of the display panel 100. A voltage level of the driving voltage ELVDD provided to a second side opposite to the first side of the display panel 100 may be lower than a voltage level of the driving voltage ELVDD provided to the first side of the display panel 100 due to resistances of wirings of the display panel 100, a capacitance between the wirings, or the like. In other words, a voltage drop may occur in the driving voltage ELVDD due to the resistances of the wirings that transmit the driving voltage ELVDD to the pixels PX and the capacitance between the wirings. Accordingly, a voltage level of the driving voltage substantially provided to the pixels PX may be different from the voltage level of the driving voltage ELVDD provided from the power supply 600.

The power supply 600 may provide the first initial reference voltage VIR1 and the second initial reference voltage VIR2 to the reference voltage generator 500. The first initial reference voltage VIR1 and the second initial reference voltage VIR2 may be voltages determined in a gamma voltage setting process performed during a manufacturing process of the display device 10. In the gamma voltage setting process, the display device 10 may be connected to a separate test device instead of the power supply 600, and may receive a test driving voltage from the test device. The display device 10 may determine the first initial reference voltage VIR1 and the second initial reference voltage VIR2 in response to the test driving voltage, and may set initial gamma voltages based thereon. For example, in the gamma voltage setting process, the display device 10 may set the initial gamma voltages based on the first initial reference voltage VIR1 and the second initial reference voltage VIR2 such that luminances according to grayscales of the pixels PX become a predetermined gamma curve (e.g., a 2.2 gamma curve).

The reference voltage generator 500 may convert the sensing driving voltage ELVDD_S generated by measuring a driving voltage detected from the pixels PX into a sensing driving current, may convert the preset reference driving voltage ELVDD_R into a reference driving current, may compare the sensing driving current and the reference driving current, and may generate the first reference voltage VR1 and the second reference voltage VR2 based on a difference between the sensing driving current and the reference driving current. The first reference voltage VR1 and the second reference voltage VR2 may compensate for a change in the driving voltage ELVDD in the display panel 100 so that the pixels PX may be normally driven.

Configuration and operation of the reference voltage generator 500 will be described below with reference to FIG. 3.

The timing controller 700 may receive input image data and an input control signal from an external device (e.g., graphic processor). The input image data may include gray-scale values corresponding to the pixels PX. The input control signal may include a vertical synchronization signal, a horizontal synchronization signal, a main clock signal, a data enable signal, or the like.

The timing controller 700 may generate the image data ID based on the input image data, and may generate the scan control signal SCS and the data control signal DCS based on the input control signal. The timing controller 700 may provide the scan control signal SCS to the scan driver 200, and may provide the data control signal DCS and the image data ID to the data driver 300. Further, the timing controller 700 may provide the reference driving voltage ELVDD_R to the reference voltage generator 500.

FIG. 1 illustrates that the timing controller 700 is implemented independently from the data driver 300, however, the present disclosure is not limited thereto. For example, the timing controller 700 may be implemented as a single integrated circuit (a timing controller embedded driver, TED) together with the data driver 300.

Further, although FIG. 1 illustrates that the gamma voltage generator 400 and the reference voltage generator 500 are implemented independently from the data driver 300 or the timing controller 700, however, the present disclosure is not limited thereto. For example, the gamma voltage generator 400 and the reference voltage generator 500 may be implemented as a single integrated circuit together with the data driver 300 or the timing controller 700. Alternatively, the gamma voltage generator 400 and the reference voltage generator 500 may be included in the data driver 300 or the timing controller 700, and may be implemented in software.

Figure 2A:
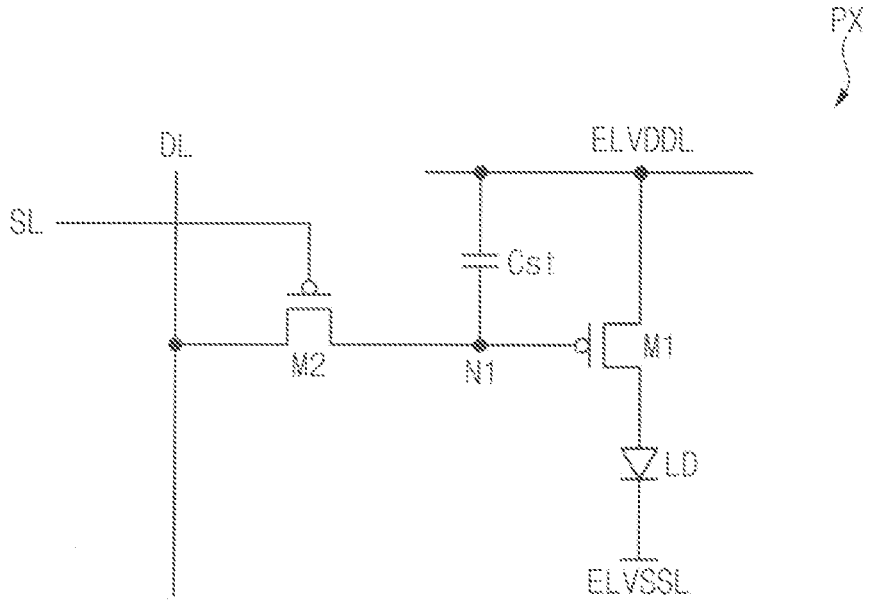
FIG. 2A is a circuit diagram illustrating a pixel included in the display device in FIG. 1.
Figure 2B:
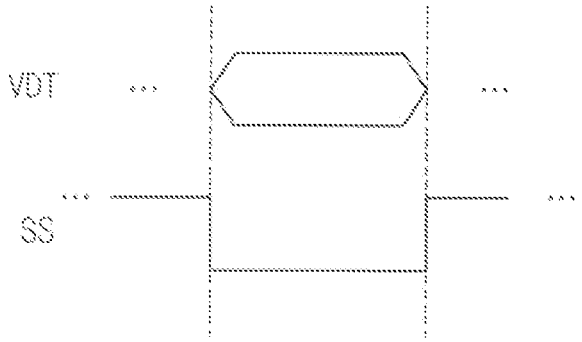
FIG. 2B is a diagram for describing a method of driving the pixel in FIG. 2A.

FIG. 2A is a circuit diagram illustrating the pixel PX included in the display device 10 in FIG. 1. FIG. 2B is a diagram for describing a method of driving the pixel PX in FIG. 2A.

Referring to FIGS. 2A and 2B, the pixel PX may be connected to the scan line SL and the data line DL. The pixel PX may include a light emitting element LD, a plurality of transistors M1 and M2, and a storage capacitor Cst.

Although FIG. 2A illustrates that each of the transistors M1 and M2 is a P-type transistor, however, the present disclosure is not limited thereto. For example, at least one of the transistors M1 and M2 may be an N-type transistor.

A first electrode (e.g., an anode electrode) of the light emitting element LD may be connected to the driving voltage line ELVDDL via the first pixel transistor M1, and a second electrode (e.g., a cathode electrode) of the light emitting element LD may be connected to the common voltage line ELVSSL. The driving voltage line ELVDDL may be a line providing the driving voltage ELVDD in FIG. 1, and the common voltage line ELVSSL may be a line providing the common voltage ELVSS in FIG. 1.

A first electrode (e.g., a source electrode) of the first pixel transistor M1 (a driving transistor) may be connected to the driving voltage line ELVDDL, and a second electrode (e.g., a drain electrode) of the first pixel transistor M1 may be connected to the first electrode of the light emitting element LD. A gate electrode of the first pixel transistor M1 may be connected to a first node N1. The first pixel transistor M1 may control a driving current supplied to the light emitting element LD in response to a voltage of the first node N1.

A first electrode (e.g., a source electrode) of the second pixel transistor M2 (a switching transistor) may be connected to the data line DL, and a second electrode (e.g., a drain electrode) of the second pixel transistor M2 may be connected to the first node N1. A gate electrode of the second pixel transistor M2 may be connected to the scan line SL.

A first electrode of the storage capacitor Cst may be connected to the first node N1, and a second electrode of the storage capacitor Cst may be connected to the driving voltage line ELVDDL. The storage capacitor Cst may be charged with a voltage corresponding to the data voltage VDT of a current frame supplied to the first node N1, and may maintain the charged voltage until the data voltage VDT of a next frame is supplied.

When the scan signal SS of a turn-on level (a low level) is supplied to the gate electrode of the second pixel transistor M2 through the scan line SL, the second pixel transistor M2 may electrically connect the data line DL to the first electrode of the storage capacitor Cst. Accordingly, a voltage corresponding to a difference between the data voltage VDT applied through the data line DL and the driving voltage ELVDD of the driving voltage line ELVDDL may be written in the storage capacitor Cst. For example, the data voltage VDT may correspond to one of the gamma voltages V0 to V255 in FIG. 1.

The first pixel transistor M1 may allow a driving current determined according to the voltage written in the storage capacitor Cst to flow from the driving voltage line ELVDDL to the common voltage line ELVSSL. The light emitting element LD may emit light with a luminance corresponding to the driving current.

Although FIG. 2A illustrates a pixel PX including two transistors M1 and M2 and one capacitor Cst, the present disclosure is not limited thereto. For example, the pixel PX may further include transistors such as a compensation transistor for compensating a threshold voltage of the first pixel transistor M1, an initialization transistor for initializing the first node N1 or the first electrode of the light emitting element LD, an emission control transistor for controlling an emission time of the light emitting element LD, or the like.

Figure 3:
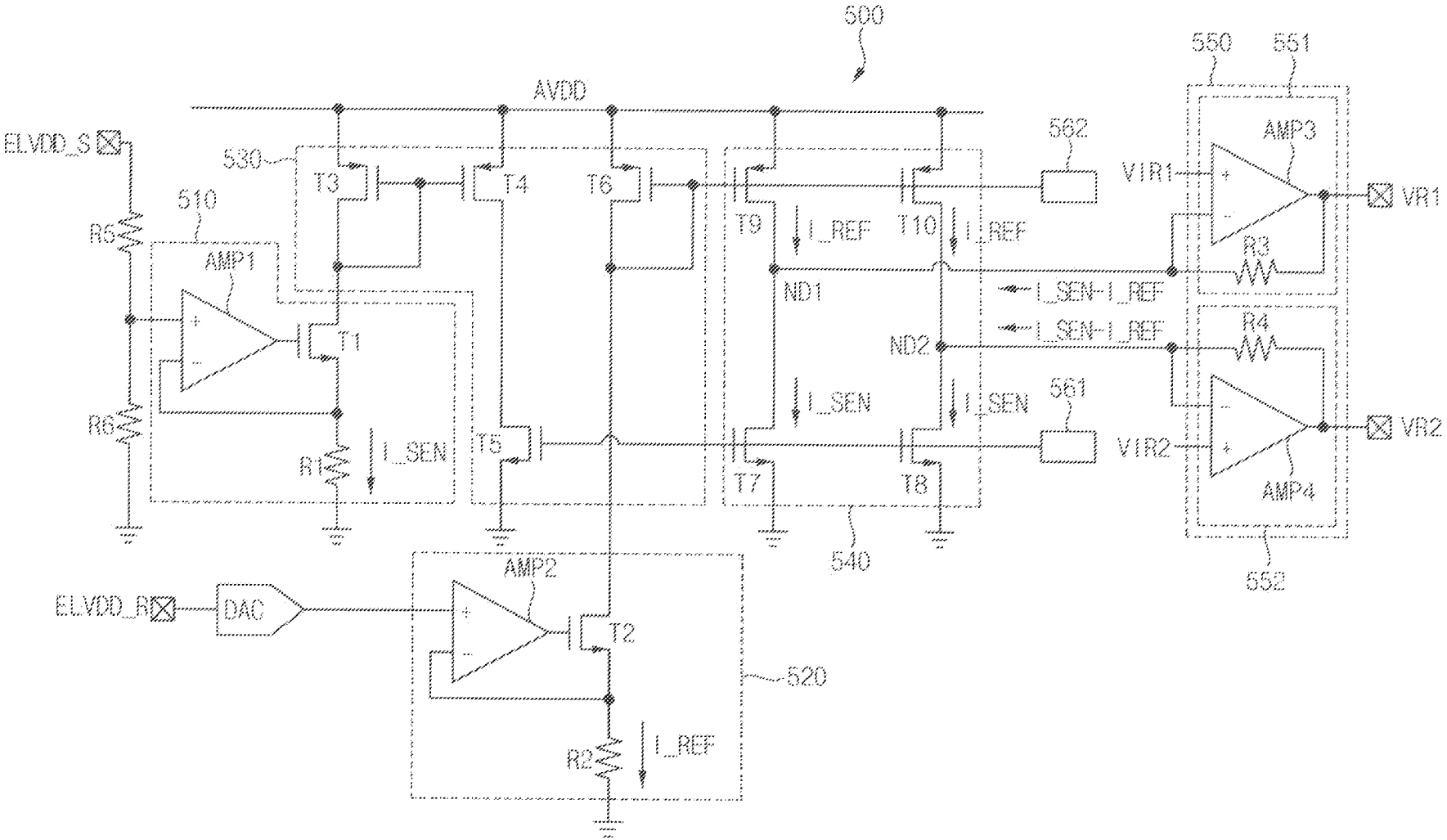
FIG. 3 is a circuit diagram illustrating a reference voltage generator according to an embodiment.

FIG. 3 is a circuit diagram illustrating a reference voltage generator 500 according to an embodiment.

Referring to FIG. 3, the reference voltage generator 500 may include a first voltage-to-current converter 510, a second voltage-to-current converter 520, a current minor block 530, a current comparator 540, and a current-to-voltage converter 550.

The first voltage-to-current converter 510 may convert the sensing driving voltage ELVDD_S into a sensing driving current I_SEN. The first voltage-to-current converter 510 may include a first amplifier AMP1, a first transistor T1, and a first resistor R1.

The sensing driving voltage ELVDD_S may be applied to a first input terminal (+) of the first amplifier AMP1 via a fifth resistor R5, and a ground voltage may be applied to the first input terminal (+) of the first amplifier AMP1 via a sixth resistor R6. For example, a resistance of the fifth resistor R5 may be four times a resistance of the sixth resistor R6. A second input terminal (−) of the first amplifier AMP1 may be connected to a first terminal of the first resistor R1 and a first electrode of the first transistor T1. An output terminal of the first amplifier AMP1 may be connected to a gate electrode of the first transistor T1.

The ground voltage may be applied to the first electrode (e.g., a source electrode) of the first transistor T1 via the first resistor R1, andan analog driving voltage AVDD may be applied to a second electrode (e.g., a drain electrode) of the first transistor T1 via a third transistor T3. The gate electrode of the first transistor T1 may be connected to the output terminal of the first amplifier AMP1. In an embodiment, the first transistor T1 may be an N-type metal oxide semiconductor ("NMOS") transistor.

The first terminal of the first resistor R1 may be connected to the second input terminal (−) of the first amplifier AMP1 and the first electrode of the first transistor T1, and the ground voltage may be applied to a second terminal of the first resistor R1.

A voltage of the first input terminal (+) of the first amplifier AMP1 may be substantially equal to a voltage of the second input terminal (−) of the first amplifier AMP1 by a virtual short-circuit between the first input terminal (+) of the first amplifier AMP1 and the second input terminal (−) of the first amplifier AMP1. Accordingly, a voltage between the opposite terminals of the first resistor R1 may be equal to the voltage of the first input terminal (+) of the first amplifier AMP1. When a resistance of the first resistor R1 is Rc, a value of the sensing driving current I_SEN flowing through the first resistor R1 may be calculated according to Equation 1.

$$I_SEN=(1/5*ELVDD_S)/RC \quad \text{[Equation 1]}$$

The second voltage-to-current converter 520 may convert the reference driving voltage ELVDD_R into a reference driving current I_REF. The second voltage-to-current converter 520 may include a second amplifier AMP2, a second transistor T2, and a second resistor R2.

A value obtained by converting the reference driving voltage ELVDD_R by a digital-to-analog converter DAC may be applied to a first input terminal (+) of the second amplifier AMP2. For example, the digital-to-analog converter DAC may apply a voltage of ⅕*ELVDD_REF to the first input terminal (+) of the second amplifier AMP2 by converting the reference driving voltage ELVDD_R. A second input terminal (−) of the second amplifier AMP2 may be connected to a first terminal of the second resistor R2 and a first electrode of the second transistor T2. An output terminal of the second amplifier AMP2 may be connected to a gate electrode of the second transistor T2.

The ground voltage may be applied to the first electrode (e.g., a source electrode) of the second transistor T2 via the second resistor R2, and the analog driving voltage AVDD may be applied to a second electrode (e.g., a drain electrode) of the second transistor T2 via a sixth transistor T6. The gate electrode of the second transistor T2 may be connected to the output terminal of the second amplifier AMP2. In an embodiment, the second transistor T2 may be an NMOS transistor.

The first terminal of the second resistor R2 may be connected to the second input terminal (−) of the second amplifier AMP2 and the first electrode of the second transistor T2, and the ground voltage may be applied to the second terminal of the second resistor R2.

A voltage of the first input terminal (+) of the second amplifier AMP2 may be substantially equal to a voltage of the second input terminal (−) of the second amplifier AMP2 by a virtual short-circuit between the first input terminal (+) of the second amplifier AMP2 and the second input terminal (−) of the second amplifier AMP2. Accordingly, a voltage between the opposite terminals of the second resistor R2 may be equal to the voltage of the first input terminal (+) of the second amplifier AMP2. When a resistance of the second resistor R2 is Rc, a value of the reference driving current I_REF flowing through the second resistor R2 may be calculated according to Equation 2.

$$I_REF=(1/5*ELVDD_R)/Rc \quad \text{[Equation 2]}$$

The current minor block 530 may transmit the sensing driving current I_SEN generated by the first voltage-to-current converter 510 and the reference driving current I_REF generated by the second voltage-to-current converter 520 to the current comparator 540. The current minor block 530 may include the third transistor T3, a fourth transistor T4, a fifth transistor T5, and the sixth transistor T6.

The analog driving voltage AVDD may be applied to a first electrode (e.g., a source electrode) of the third transistor T3, and a second electrode (e.g., a drain electrode) of the third transistor T3 may be connected to the second electrode of the first transistor T1. A gate electrode of the third transistor T3 may be connected to the second electrode of the third transistor T3 and a gate electrode of the fourth transistor T4. In an embodiment, the third transistor T3 may be a P-type metal oxide semiconductor ("PMOS") transistor. Since the third transistor T3 is series-connected to the first transistor T1, the sensing driving current I_SEN flowing through the first transistor T1 may flow through the third transistor T3.

The analog driving voltage AVDD may be applied to a first electrode (e.g., a source electrode) of the fourth transistor T4, and a second electrode (e.g., a drain electrode) of the fourth transistor T4 may be connected to a second electrode of the fifth transistor T5. A gate electrode of the fourth transistor T4 may be connected to the gate electrode of the third transistor T3. In an embodiment, the fourth transistor T4 may be a PMOS transistor. The third transistor T3 and the fourth transistor T4 may form a circuit structure of a current minor. Accordingly, the sensing driving current I_SEN may flow through the fourth transistor T4.

The ground voltage may be applied to a first electrode (e.g., a source electrode) of the fifth transistor T5, and a second electrode (e.g., a drain electrode) of the fifth transistor T5 may be connected to the second electrode of the fourth transistor T4. A gate electrode of the fifth transistor T5 may be connected to a gate electrode of a seventh transistor T7 and a gate electrode of an eighth transistor T8. In an embodiment, the fifth transistor T5 may be an NMOS transistor. Since the fifth transistor T5 is series-connected to the fourth transistor T4, the sensing driving current I_SEN flowing through the fourth transistor T4 may flow through the fifth transistor T5.

The analog driving voltage AVDD may be applied to a first electrode (e.g., a source electrode) of the sixth transistor T6, and a second electrode (e.g., a drain electrode) of the sixth transistor T6 may be connected to the second electrode of the second transistor T2. A gate electrode of the sixth transistor T6 may be connected to the second electrode of the sixth transistor T6, a gate electrode of a ninth transistor T9, and a gate electrode of a tenth transistor T10. In an embodiment, the sixth transistor T6 may be a PMOS transistor. Since the sixth transistor T6 is series-connected to the second transistor T2, the reference driving current I_REF flowing through the second transistor T2 may flow through the sixth transistor T6.

The current comparator 540 may compare the sensing driving current I_SEN with the reference driving current I_REF. The current comparator 540 may include the seventh transistor T7, the eighth transistor T8, the ninth transistor T9, and the tenth transistor T10.

The ground voltage may be applied to a first electrode (e.g., a source electrode) of the seventh transistor T7, and a second electrode (e.g., a drain electrode) of the seventh transistor T7 may be connected to a first node ND1. The gate electrode of the seventh transistor T7 may be connected to the gate electrode of the fifth transistor T5. In an embodiment, the seventh transistor T7 may be an NMOS transistor. The fifth transistor T5 and the seventh transistor T7 may form a circuit structure of a current minor. Accordingly, the sensing driving current I_SEN may flow through the seventh transistor T7.

The ground voltage may be applied to a first electrode (e.g., a source electrode) of the eighth transistor T8, and a second electrode (e.g., a drain electrode) of the eighth transistor T8 may be connected to a second node ND2. The gate electrode of the eighth transistor T8 may be connected to the gate electrode of the fifth transistor T5. In an embodiment, the eighth transistor T8 may be an NMOS transistor. The fifth transistor T5 and the eighth transistor T8 may form a circuit structure of a current minor. Accordingly, the sensing driving current I_SEN may flow through the eighth transistor T8.

The analog driving voltage AVDD may be applied to a first electrode (e.g., a source electrode) of the ninth transistor T9, and a second electrode (e.g., a drain electrode) of the ninth transistor T9 may be connected to the first node ND1. The gate electrode of the ninth transistor T9 may be connected to the gate electrode of the sixth transistor T6. In an embodiment, the ninth transistor T9 may be a PMOS transistor. The sixth transistor T6 and the ninth transistor T9 may form a circuit structure of a current minor. Accordingly, the reference driving current I_REF may flow through the ninth transistor T9.

The analog driving voltage AVDD may be applied to a first electrode (e.g., a source electrode) of the tenth transistor T10, and a second electrode (e.g., a drain electrode) of the tenth transistor T10 may be connected to the second node ND2. The gate electrode of the tenth transistor T10 may be connected to the gate electrode of the sixth transistor T6. In an embodiment, the tenth transistor T10 may be a PMOS transistor. The sixth transistor T6 and the tenth transistor T10 may form a circuit structure of a current minor. Accordingly, the reference driving current I_REF may flow through the tenth transistor T10.

Since the sensing driving current I_SEN flows through the seventh transistor T7, the reference driving current I_REF flows through the ninth transistor T9, and the ninth transistor T9 is series-connected to the seventh transistor T7 through the first node ND1, a current I_SEN-I_REF corresponding to a difference between the sensing driving current I_SEN and the reference driving current I_REF may flow from the current-to-voltage converter 550 to the first node ND1. Since the sensing driving current I_SEN flows through the eighth transistor T8, the reference driving current I_REF flows through the tenth transistor T10, and the tenth transistor T10 is series-connected to the eighth transistor T8 through the second node ND2, a current I_SEN-I_REF corresponding to a difference between the sensing driving current I_SEN and the reference driving current I_REF may flow from the current-to-voltage converter 550 to the second node ND2.

The current-to-voltage converter 550 may generate the first reference voltage VR1 and the second reference voltage VR2 based on the difference between the sensing driving current I_SEN and the reference driving current I_REF. The current-to-voltage converter 550 may include a first current-to-voltage converter 551 and a second current-to-voltage converter 552.

The first current-to-voltage converter 551 may generate the first reference voltage VR1 based on the difference between the sensing driving current I_SEN and the reference driving current I_REF. The first current-to-voltage converter 551 may include a third amplifier AMP3 and a third resistor R3.

A first initial reference voltage VIR1 may be applied to a first input terminal (+) of the third amplifier AMP3. A second input terminal (−) of the third amplifier AMP3 may be connected to the first node ND1. An output terminal of the third amplifier AMP3 may be connected to a first output terminal from which the first reference voltage VR1 is output.

A first terminal of the third resistor R3 may be connected to the first node ND1, and a second terminal of the third resistor R3 may be connected to the output terminal of the third amplifier AMP3.

Since the third resistor R3 is connected between the second input terminal (−) and the output terminal of the third amplifier AMP3, a value obtained by subtracting a value obtained by multiplying a resistance of the third resistor R3 by a valueI_SEN-IREF obtained by subtracting the reference driving current I_REF from the sensing driving current I_SEN from a voltage of the output terminal of the third amplifier AMP3 may be applied to the second input terminal (−) of the third amplifier AMP3. When the resistance of the third resistor R3 is 5*Rc, a value of the first reference voltage VR1 may be calculated according to Equation 3.

$$VR1=VIR1+5*Rc*(I_SEN-I_REF)=VIR1+(ELVDD_S-ELVDD_R) \quad \text{[Equation 3]}$$

Accordingly, the first reference voltage VR1 may have a value in which a change in the driving voltage is compensated with the first initial reference voltage VIR1.

The second current-to-voltage converter 552 may generate the second reference voltage VR2 based on the difference between the sensing driving current I_SEN and the reference driving current I_REF. The second current-to-voltage converter 552 may include a fourth amplifier AMP4 and a fourth resistor R4.

A second initial reference voltage VIR2 may be applied to a first input terminal (+) of the fourth amplifier AMP4. A second input terminal (−) of the fourth amplifier AMP4 may be connected to the second node ND2. An output terminal of the fourth amplifier AMP4 may be connected to a second output terminal from which the second reference voltage VR2 is output.

A first terminal of the fourth resistor R4 may be connected to the second node ND2, and a second terminal of the fourth resistor R4 may be connected to the output terminal of the fourth amplifier AMP4.

Since the fourth resistor R4 is connected between the second input terminal (−) and the output terminal of the fourth amplifier AMP4, a value obtained by subtracting a value obtained by multiplying a resistance of the fourth resistor R4 by a valueI_SEN-IREF obtained by subtracting the reference driving current I_REF from the sensing driving current I_SEN from a voltage of the output terminal of the fourth amplifier AMP4 may be applied to the second input terminal (−) of the fourth amplifier AMP4. When the resistance of the fourth resistor R3 is 5*Rc, a value of the second reference voltage VR2 may be calculated according to Equation 4.

$$Vr2=VIR2+5*Rc*(I_SEN-I_REF)=VIR2+(ELVDD_S-ELVDD_R) \quad \text{[Equation 4]}$$

Accordingly, the second reference voltage VR2 may have a value in which a change in the driving voltage is compensated with the second initial reference voltage VIR2.

In an embodiment, the reference voltage generator 500 may further include a first current clamp 561 and a second current clamp 562. The first current clamp 561 may limit a range of the sensing driving current I_SEN. For example, the first current clamp 561 may define an upper limit of the sensing driving current I_SEN. The second current clamp 562 may limit a range of the reference driving current I_REF. For example, the second current clamp 562 may define an upper limit of the reference driving current I_REF.

The first current clamp 561 may be connected to the gate electrode of the fifth transistor T5, the gate electrode of the seventh transistor T7, and the gate electrode of the eighth transistor T8. The second current clamp 562 may be connected to the gate electrode of the sixth transistor T6, the gate electrode of the ninth transistor T9, and the gate electrode of the tenth transistor T10.

As the first current clamp 561 limits the range of the sensing driving current I_SEN and the second current clamp 562 limits the range of the reference driving current I_REF, a range of the first reference voltage VR1 and a range of the second reference voltage VR2 may be limited. For example, when the upper limit of the sensing driving current I_SEN and the upper limit of the reference driving current I_REF are defined, each of the first reference voltage VR1 and the second reference voltage VR2 may operate only within a predetermined range. In other words, when the upper limit of the sensing driving current I_SEN and the upper limit of the reference driving current I_REF are defined, an upper limit and a lower limit of each of the first reference voltage VR1 and the second reference voltage VR2 may be defined.

Figure 4A:
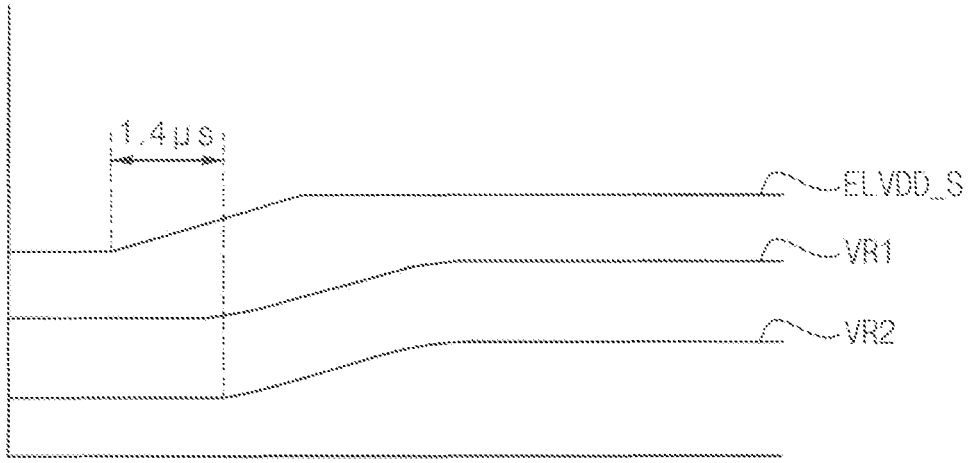
FIG. 4A (PRIOR ART)
FIGS. 4A and 4B are diagrams for describing reaction rates of a voltage method of prior art and a current method.
Figure 4B:
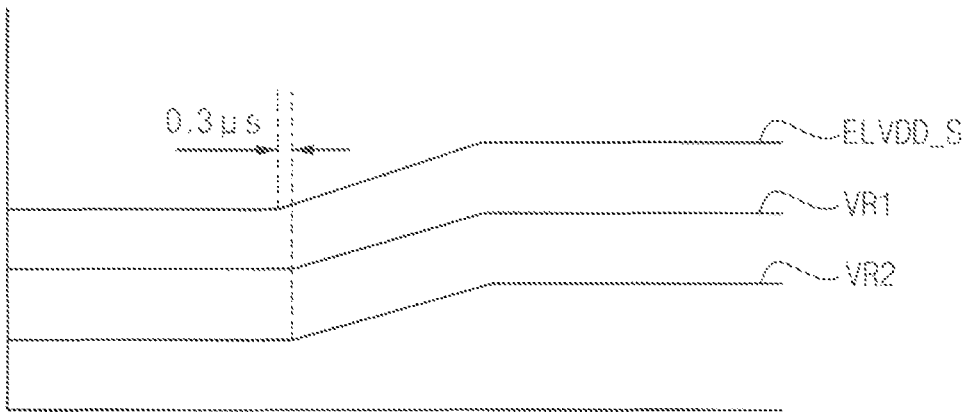

FIGS. 4A and 4B are diagrams for describing reaction rates of a voltage method and a current method. The voltage method refers to a method of comparing the sensing driving voltage ELVDD_S and the reference driving voltage ELVDD_R, and the current method refers to a method of comparing the sensing driving current I_SEN and the reference driving current I_REF.

Referring to FIG. 4A, when the reference voltages VR1 and VR2 are generated by the voltage method according to a comparative embodiment of the prior art, a time period (e.g., about 1.4 μs) from a time point in which the sensing driving voltage ELVDD_S changes to a time point in which the first reference voltage VR1 and the second reference voltage VR2 changes may be relatively large. In other words, when the reference voltages VR1 and VR2 are generated by the voltage method according to a comparative embodiment of the prior art, reaction rates of the reference voltages VR1 and VR2 to the change of the sensing driving voltage ELVDD_S may be relatively slow. In the case of the voltage method according to the comparative example of the prior art, since the voltage loss, such as a voltage drop or the like, is large due to impedance or the like, the reaction rates of the reference voltages VR1 and VR2 to the change of the sensing driving voltage ELVDD_S may be relatively slow. When the reaction rates of the reference voltages VR1 and VR2 to the change of the sensing driving voltage ELVDD_S is slow, the gamma voltages V0 to V255 may change slowly in response to the change of the sensing driving voltage ELVDD_S, and accordingly, noise or flicker may be generated on a display screen.

However, referring to FIG. 4B, when the reference voltages VR1 and VR2 are generated by the current method according to the embodiment of the present disclosure, a time period (e.g., about 0.3 μs) from a time point in which the sensing driving voltage ELVDD_S changes to a time point in which the first reference voltage VR1 and the second reference voltage VR2 changes may be relatively small. In other words, when the reference voltages VR1 and VR2 are generated by the current method according to the embodiment of the present disclosure, the reaction rates of the reference voltages VR1 and VR2 to the change of the sensing driving voltage ELVDD_S is relatively fast. In the case of the current method according to the embodiment of the present disclosure, since the distortion is small because the current loss is small and the influence of the impedance or the like is small, the reaction rates of the reference voltages VR1 and VR2 to the change of the sensing driving voltage ELVDD_S may be relatively fast. When the reaction rates of the reference voltages VR1 and VR2 to the change of the sensing driving voltage ELVDD_S is fast, the gamma voltages V0 to V255 may change rapidly in response to the change of the sensing driving voltage ELVDD_S, and accordingly, noise or flicker may not occur on the display screen.

Figure 5A:
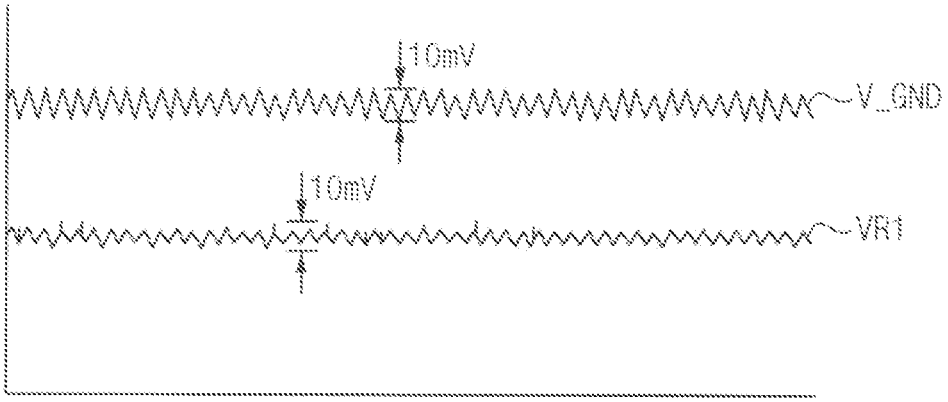
FIG. 5A (PRIOR ART)
FIGS. 5A and 5B are diagrams for describing noise of the voltage method of prior art and a current method.
Figure 5B:
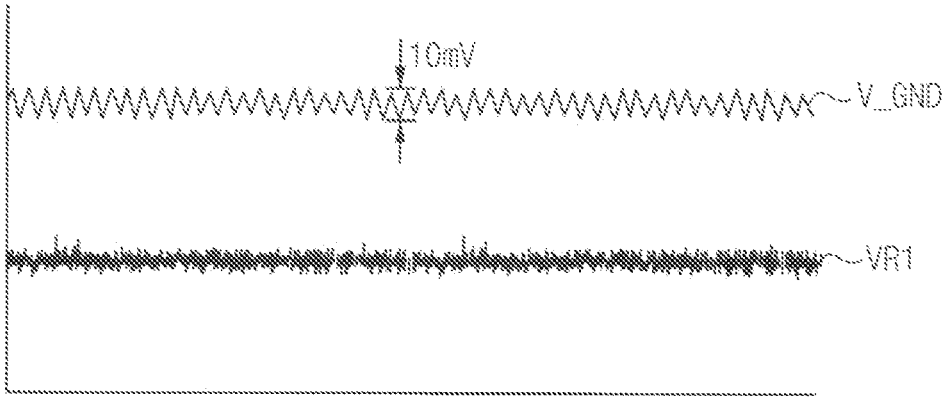

FIGS. 5A and 5B are diagrams for describing noise of the voltage method and the current method.

Referring to FIG. 5A, when the reference voltage VR1 is generated by the voltage method according to the comparative example of the prior art, a ground noise applied to the ground voltage V_GND may affect the reference voltage VR1. In other words, when the reference voltage VR1 is generated by the voltage method according to the comparative example of the prior art, the reference voltage VR1 may include a noise corresponding to the ground noise. In the case of the voltage method according to the comparative example of the prior art, since the ground noise is amplified by the amplifier, the ground noise applied to the ground voltage V_GND may affect the reference voltage VR1. When the ground noise applied to the ground voltage V_GND affects the reference voltage VR1, the gamma voltages V0 to V255 may include a noise, and accordingly, the noise may be generated on the display screen.

However, referring to FIG. 5B, when the reference voltage VR1 is generated by the current method according to the embodiment of the present disclosure, the ground noise applied to the ground voltage V_GND may not affect the reference voltage VR1. In other words, when the reference voltage VR1 is generated by the current method according to the embodiment of the present disclosure, the reference voltage VR1 may not include the noise corresponding to the ground noise. In the case of the current method according to the embodiment of the present disclosure, since the change in the initial reference voltages VIR1 and VIR2 due to the ground noise is offset by the change in the difference between the sensing driving current I_SEN and the reference driving current I_REF due to the ground noise, the ground noise applied to the ground voltage V_GND may not affect the reference voltage VR1. For example, when the initial reference voltages VIR1 and VIR2 increase due to the ground noise, the difference between the sensing driving current I_SEN and the reference driving current I_REF may decrease due to the ground noise. Further, when the initial reference voltages VIR1 and VIR2 decrease due to the ground noise, the difference between the sensing driving current I_SEN and the reference driving current I_REF may increase due to the ground noise. When the ground noise applied to the ground voltage V_GND does not affect the reference voltage VR1, the gamma voltages V0 to V255 may not include a noise, and accordingly, the noise may not be generated on the display screen.

Figure 6:
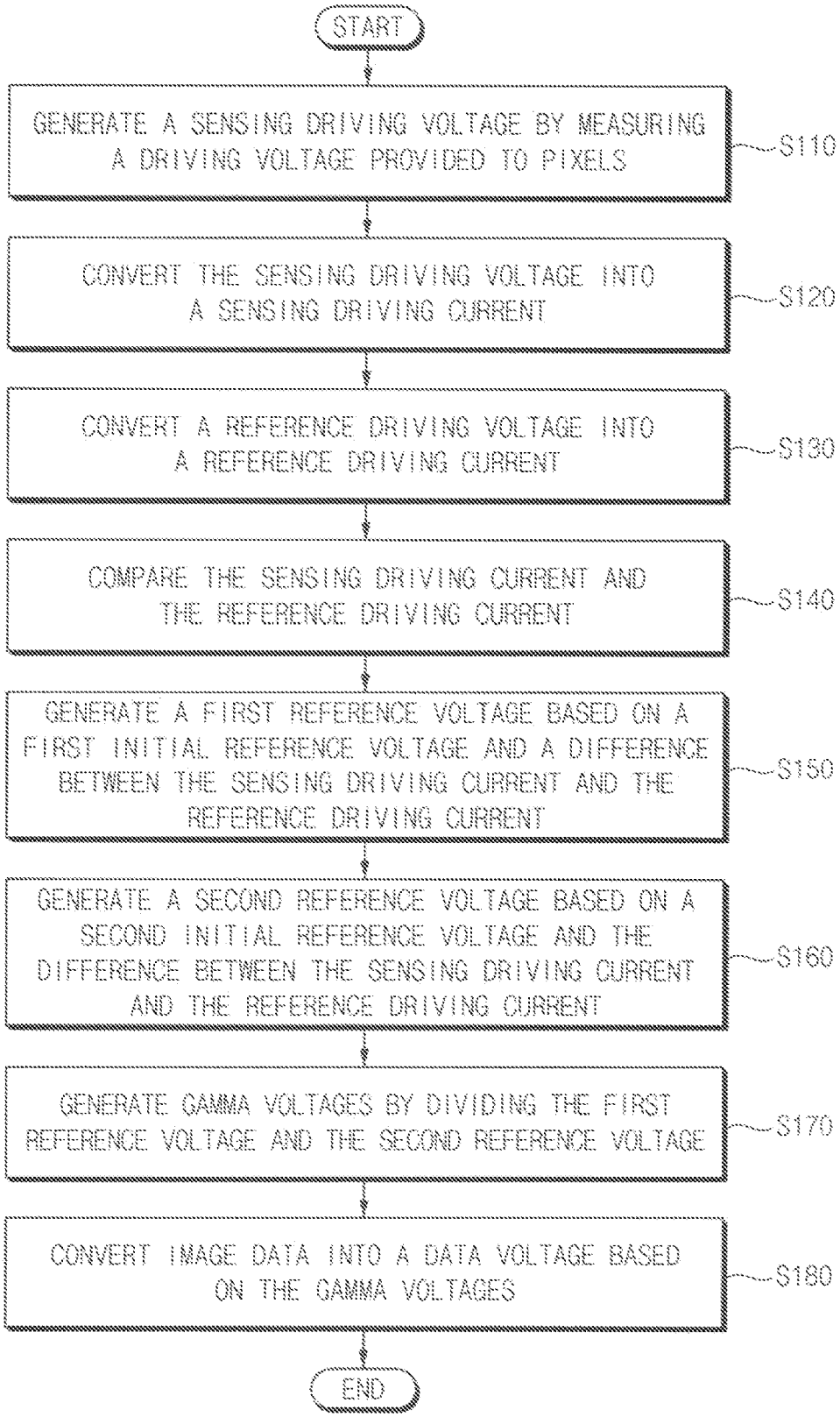
FIG. 6 is a flowchart illustrating a method of driving a display device according to an embodiment.

FIG. 6 is a flowchart illustrating a method of driving a display device according to an embodiment.

Referring to FIG. 6, the sensing driving voltage ELVDD_S may be generated by measuring the driving voltage ELVDD provided to the plurality of pixels PX (S110). The power supply 600 may provide the driving voltage ELVDD to the pixels PX, and the sensing driving voltage ELVDD_S may be a voltage generated by measuring the driving voltage ELVDD provided to the pixels PX.

Then, the first voltage-to-current converter 510 of the reference voltage generator 500 may convert the sensing driving voltage ELVDD_S into the sensing driving current I_SEN (S120).

Then, the second voltage-to-current converter 520 of the reference voltage generator 500 may convert the preset reference driving voltage EVLDD_R into the reference driving current I_REF (S130). The timing controller 700 may provide the reference driving voltage EVLDD_R to the reference voltage generator 500, and the reference driving voltage ELVDD_R may be a target driving voltage for normally driving the pixels PX.

Then, the current comparator 540 of the reference voltage generator 500 may compare the sensing driving current I_SEN and the reference driving current I_REF (S140). The current minor block 530 of the reference voltage generator 500 may transmit the sensing driving current I_SEN generated by the first voltage-to-current converter 510 and the reference driving current I_REF generated by the second voltage-to-current converter 520 to the current comparator 540.

Then, the current-to-voltage converter 550 of the reference voltage generator 500 may generate the first reference voltage VR1 and the second reference voltage VR2 based on the difference between the sensing driving current I_SEN and the reference driving current I_REF. The first current-to-voltage converter 551 of the current-to-voltage converter 550 may generate the first reference voltage VR1 based on the first initial reference voltage VIR1 and the difference between the sensing driving current I_SEN and the reference driving current I_REF (S150), and the second current-to-voltage converter 552 of the current-to-voltage converter 550 may generate the second reference voltage VR2 based on the second initial reference voltage VIR2 and the difference between the sensing driving current I_SEN and the reference driving current I_REF (S160).

Then, the gamma voltage generator 400 may divide the first reference voltage VR1 and the second reference voltage VR2 to generate the plurality of gamma voltages V0 to V255 (S170). The gamma voltages V0 to V255 may be intermediate voltages between the first reference voltage VR1 and the second reference voltage VR2. The gamma voltages V0 to V255 may vary in response to the first reference voltage VR1 and the second reference voltage VR2.

Then, the data driver 300 may convert the image data ID into the data voltage VDT based on the gamma voltages V0 to V255 (S180). The data driver 300 may provide the data voltage VDT to the pixels PX.

Figure 7:
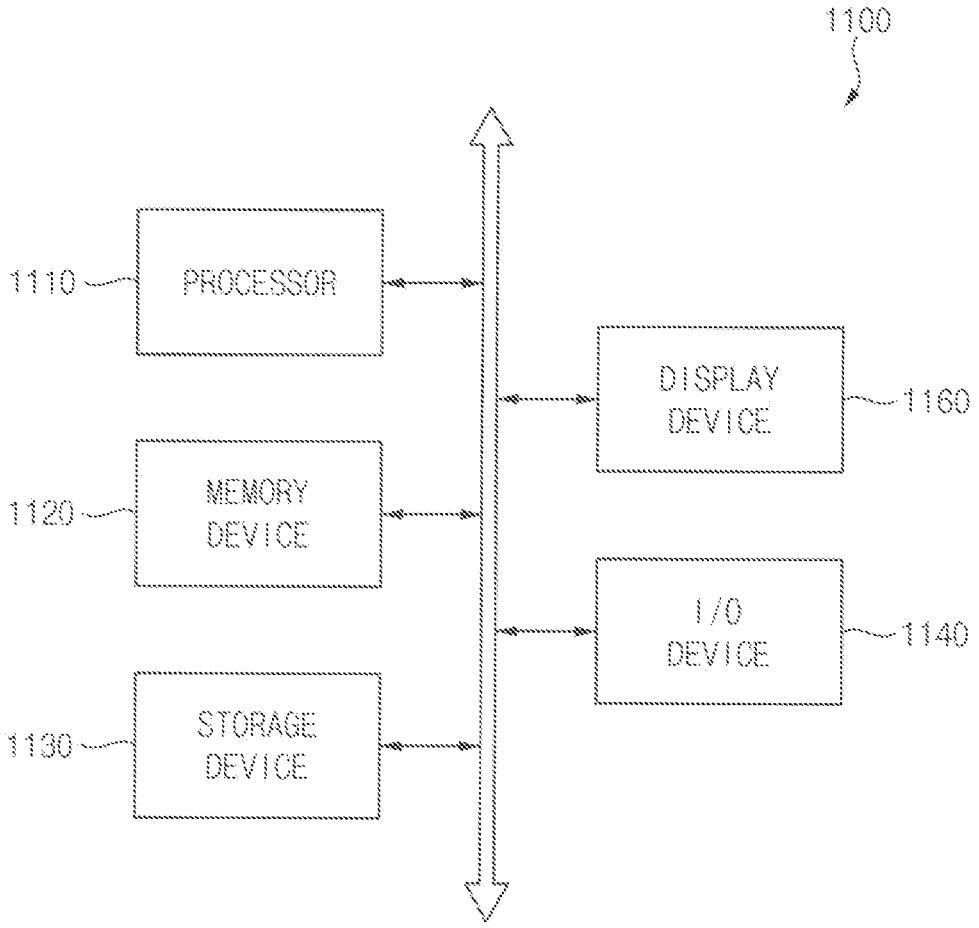
FIG. 7 is a block diagram illustrating an electronic apparatus including a display device according to an embodiment.

FIG. 7 is a block diagram illustrating an electronic apparatus 1100 including a display device 1160 according to an embodiment.

Referring to FIG. 7, the electronic apparatus 1100 may include a processor 1110, a memory device 1120, a storage device 1130, an input/output ("I/O") device 1140, and a display device 1160. The electronic apparatus 1100 may further include a plurality of ports for communicating with a video card, a sound card, a memory card, a universal serial bus ("USB") device, and etc.

The processor 1110 may perform particular calculations or tasks. In an embodiment, the processor 1110 may be a microprocessor, a central processing unit ("CPU"), or the like. The processor 1110 may be coupled to other components via an address bus, a control bus, a data bus, or the like. In an embodiment, the processor 1110 may be coupled to an extended bus such as a peripheral component interconnection ("PCI") bus.

The memory device 1120 may store data for operations of the electronic apparatus 1100. In an embodiment, the memory device 1120 may include a non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or a volatile memory device such as a dynamic random access memory ("DRAM") device, a static random access memory ("SRAM") device, a mobile DRAM device, etc.

The storage device 1130 may include a solid state drive ("SSD") device, a hard disk drive ("HDD") device, a CD-ROM device, or the like. The I/O device 1140 may include an input device such as a keyboard, a keypad, a touchpad, a touch-screen, a mouse device, etc., and an output device such as a speaker, a printer, and etc. The display device 1160 may be coupled to other components via the buses or other communication links.

In the display device 1160, each of the sensing driving voltage and the reference driving voltage may be respectively converted into the sensing driving current and the reference driving current. Then, the sensing driving current and the reference driving current may be compared, and the reference voltage may be generated based on the difference between the sensing driving current and the reference driving current so that the change in the driving voltage may be rapidly compensated, and the reference voltage may not include the noise.

The display device according to the embodiments may be applied to a display device included in a computer, a notebook, a mobile phone, a smartphone, a smart pad, a PMP, a PDA, an MP3 player, or the like.

Although the display devices, the reference voltage generators, and the methods of driving the display devices according to the embodiments have been described with reference to the drawings, the illustrated embodiments are examples, and may be modified and changed by a person having ordinary knowledge in the relevant technical field without departing from the technical spirit described in the following claims.

What is claimed is:

1. A display device, comprising:

a display panel including a plurality of pixels displaying an image based on a driving voltage;

a reference voltage generator converting a sensing driving voltage generated by measuring the driving voltage into a sensing driving current, converting a preset reference driving voltage into a reference driving current, comparing the sensing driving current and the reference driving current, and generating a first reference voltage and a second reference voltage based on a difference between the sensing driving current and the reference driving current;

a gamma voltage generator generating a plurality of gamma voltages by dividing the first reference voltage and the second reference voltage; and a data driver converting image data into a data voltage based on the gamma voltages and providing the data voltage to each of the pixels.

2. The display device of claim 1, wherein the reference voltage generator includes:

a first voltage-to-current converter converting the sensing driving voltage into the sensing driving current;

a second voltage-to-current converter converting the reference driving voltage into the reference driving current;

a current comparator comparing the sensing driving current and the reference driving current; and a current-to-voltage converter generating the first reference voltage and the second reference voltage based on the difference between the sensing driving current and the reference driving current.

3. The display device of claim 2, wherein the current-to-voltage converter includes:

a first current-to-voltage converter generating the first reference voltage based on a first initial reference voltage and the difference between the sensing driving current and the reference driving current; and a second current-to-voltage converter generating the second reference voltage based on a second initial reference voltage and the difference between the sensing driving current and the reference driving current.

4. The display device of claim 3, wherein the first current-to-voltage converter includes a first amplifier outputting the first reference voltage based on the first initial reference voltage and the difference between the sensing driving current and the reference driving current, and wherein the second current-to-voltage converter includes a second amplifier outputting the second reference voltage based on the second initial reference voltage and the difference between the sensing driving current and the reference driving current.

5. The display device of claim 2, wherein the first voltage-to-current converter includes:

a first amplifier having a first input terminal to which the sensing driving voltage is applied;

a first resistor connected to a second input terminal of the first amplifier and through which the sensing driving current flows; and a first transistor series-connected to the first resistor and having a gate electrode connected to an output terminal of the first amplifier, and wherein the second voltage-to-current converter includes:

a second amplifier having a first input terminal to which the reference driving voltage is applied;

a second resistor connected to a second input terminal of the second amplifier and through which the reference driving current flows; and a second transistor series-connected to the second resistor and having a gate electrode connected to an output terminal of the second amplifier.

6. The display device of claim 2, wherein the current comparator includes:

a first transistor through which the sensing driving current flows; and a second transistor series-connected to the first transistor and through which the reference driving current flows.

7. The display device of claim 6, wherein the first transistor is an N-type metal oxide semiconductor ("NMOS") transistor, and wherein the second transistor is a P-type metal oxide semiconductor ("PMOS") transistor.

8. The display device of claim 2, wherein the reference voltage generator further includes:

a current minor block transmitting the sensing driving current generated from the first voltage-to-current converter and the reference driving current generated from the second voltage-to-current converter to the current comparator.

9. The display device of claim 2, wherein the reference voltage generator further includes:

a first current clamp limiting a range of the sensing driving current; and a second current clamp limiting a range of the reference driving current.

10. The display device of claim 1, further comprising:

a timing controller controlling a driving of the data driver and providing the reference driving current to the reference voltage generator.

11. The display device of claim 1, wherein the reference driving voltage is a target driving voltage in driving the pixels normally.

12. The display device of claim 1, further comprising:

a power supply providing the driving voltage to the pixels and providing a first initial reference voltage for generating the first reference voltage and a second initial reference voltage in order to generate the second reference voltage to the reference voltage generator.

13. A reference voltage generator, comprising:

a first voltage-to-current converter converting a sensing driving voltage generated by measuring a driving voltage provided to pixels into a sensing driving current;

a second voltage-to-current converter converting a preset reference driving voltage into a reference driving current;

a current comparator comparing the sensing driving current and the reference driving current; and a current-to-voltage converter generating a first reference voltage and a second reference voltage based on a difference between the sensing driving current and the reference driving current.

14. The reference voltage generator of claim 13, wherein the current-to-voltage converter includes:

a first current-to-voltage converter generating the first reference voltage based on a first initial reference voltage and the difference between the sensing driving current and the reference driving current; and a second current-to-voltage converter generating the second reference voltage based on a second initial reference voltage and the difference between the sensing driving current and the reference driving current.

15. The reference voltage generator of claim 14, wherein the first current-to-voltage converter includes a first amplifier outputting the first reference voltage based on the first initial reference voltage and the difference between the sensing driving current and the reference driving current, and wherein the second current-to-voltage converter includes a second amplifier outputting the second reference voltage based on the second initial reference voltage and the difference between the sensing driving current and the reference driving current.

16. The reference voltage generator of claim 13, wherein the current comparator includes:

a first transistor through which the sensing driving current flows; and a second transistor series-connected to the first transistor and through which the reference driving current flows.

17. The reference voltage generator of claim 16, wherein the first transistor is an NMOS transistor, and wherein the second transistor is a PMOS transistor.

18. The reference voltage generator of claim 13, further comprising:

a current minor block transmitting the sensing driving current generated from the first voltage-to-current converter and the reference driving current generated from the second voltage-to-current converter to the current comparator.

19. A method of driving a display device, the method comprising steps of:

generating a sensing driving voltage by measuring a driving voltage provided to a plurality of pixels;

converting the sensing driving voltage into a sensing driving current;

converting a preset reference driving voltage into a reference driving current;

comparing the sensing driving current and the reference driving current;

generating a first reference voltage and a second reference voltage based on a difference between the sensing driving current and the reference driving current; and generating a plurality of gamma voltages by dividing the first reference voltage and the second reference voltage.

20. The method of claim 19, wherein generating the first reference voltage and the second reference voltage is accomplished by generating the first reference voltage based on a first initial reference voltage and the difference between the sensing driving current and the reference driving current, and generating the second reference voltage based on a second initial reference voltage and the difference between the sensing driving current and the reference driving current.

* * * * *